US007845337B2

(12) United States Patent
Song

(10) Patent No.: US 7,845,337 B2
(45) Date of Patent: Dec. 7, 2010

(54) FUEL VAPOR RECIRCULATION DEVICE FOR VEHICLE

(75) Inventor: Ju Tae Song, Suwon (KR)

(73) Assignee: Hyundai Motor Company, Seoul (KR)

( * ) Notice: Subject to any disclaimer, the term of this patent is extended or adjusted under 35 U.S.C. 154(b) by 120 days.

(21) Appl. No.: 12/270,742

(22) Filed: Nov. 13, 2008

(65) Prior Publication Data

US 2009/0250039 A1 Oct. 8, 2009

(30) Foreign Application Priority Data

Apr. 7, 2008 (KR) ..... 10-2008-0032327

(51) Int. Cl.
*F02M 33/02* (2006.01)
*F02M 33/04* (2006.01)

(52) U.S. Cl. ..... 123/520; 123/519

(58) Field of Classification Search ..... 123/519, 123/520, 518, 516; 137/587, 588
See application file for complete search history.

(56) References Cited

U.S. PATENT DOCUMENTS 5,635,630 A * 6/1997 Dawson et al. ..... 73/40.5 R
5,878,729 A * 3/1999 Covert et al. ..... 123/520
6,499,472 B2 * 12/2002 Weldon et al. ..... 123/520

* cited by examiner

*Primary Examiner*—Mahmoud Gimie
(74) *Attorney, Agent, or Firm*—Morgan, Lewis & Bockius LLP

(57) ABSTRACT

A fuel vapor recirculation device may includes: a canister that is connected with a fuel tank through a vapor line and a purge line configured with a pressure control solenoid valve; a vapor control valve that is disposed on the vapor line and selectively connects the fuel tank and the canister corresponding to operation of an engine control unit; a vapor recirculation valve unit that is connected with the canister, receives fuel vapor from the canister, discharges the fuel vapor to the atmosphere or recirculates the fuel vapor to the canister, and supplies air to the canister; and a one-way check valve that is disposed between the purge line and the canister, wherein the one-way check valve supplies air to the vapor recirculation valve unit when a negative pressure is generated in the purge line.

15 Claims, 6 Drawing Sheets

FUEL VAPOR RECIRCULATION DEVICE FOR VEHICLE

CROSS-REFERENCE TO RELATED APPLICATION

The present application claims priority to and the benefit of Korean Patent Application No. 10-2008-0032327 filed Apr. 7, 2008, the entire contents of which application is incorporated herein for all purposes by this reference.

BACKGROUND OF THE INVENTION

1. Field of the Invention

The present invention relates to a fuel vapor recirculation device. More particularly, the present invention relates to a fuel vapor recirculation device for a vehicle that can recirculate fuel vapor that is exhausted from a canister back to the canister, and minimize discharging fuel vapor to the atmosphere.

2. Description of Related Art

In the automotive industry, there has been research on improvement of emissions. For minimizing hydrocarbons (HC) in evaporation gas of gasoline fuel, emissions from fuel evaporation have been reduced to under 0.5 g/day in some countries, and it will be further limited to under 0.054 g/day by law.

For adhering to that limitation, improvements in fuel tank materials and optimizing connection structures have been studied in order to minimize generation of fuel evaporation gas that permeate the fuel tank, and a fuel vapor recirculation device provided with a canister has also been used.

The canister contains an absorbent material such as activated carbon for absorbing the fuel vapor or fuel evaporation gas from the fuel tank or a float chamber and for preventing discharge of the fuel vapor or fuel evaporation gas to the atmosphere.

The absorbed fuel vapor can be transmitted to an engine for combustion through a pressure control solenoid valve, for example, a Purge Control Solenoid Valve (PCSV) that is controlled by an engine control unit (ECU).

That is, a conventional fuel vapor recirculation device 101, as shown in FIG. 6, includes a fuel tank 103, a canister 105, a pressure control solenoid valve 107, a Canister Close Valve (CCV) 109, and an assistance canister 111.

The canister 105 is connected with the fuel tank 103 through a vapor line 113, to the pressure control solenoid valve 107 through a purge line 115, and to the canister close valve 109 through a vent line 117.

The assistance canister 111 is disposed to the vent line 117 that connects the canister 105 and the canister close valve 109.

The fuel vapor or fuel evaporation gas from the fuel tank 103 are absorbed to the canister 105 through the vapor line 113 and transmitted to an engine through the purge line 115 that is open or closed by the pressure control solenoid valve 107 in accordance with operation of the ECU 119.

Further, when the fuel vapor in the canister 105 is saturated, the canister close valve 109 is opened by operation of the ECU 119 and the fuel vapor is transmitted and absorbed to the assistance canister 111 and then discharged to the atmosphere, so that discharged fuel vapor can be minimized.

However, when the size of a canister of the conventional fuel vapor recirculation device is increased for reducing exhausted fuel evaporation gas, an unpredictable phenomenon can occur due to resistance in the canister, and the fuel tank can be repeatedly constricted due to negative engine pressure such that optimally constructing a fuel vapor recirculation device is difficult.

Also, when the assistance canister is used, discharging fuel vapor can be minimized, but cost for manufacturing and weight of a fuel vapor recirculation device is increased and layout is complicated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

An aspect of the present invention is directed to a fuel vapor recirculation device including a canister that is connected with a fuel tank through a vapor line and with a purge line configured with a pressure control solenoid valve, a vapor control valve that is disposed on the vapor line and selectively connects the fuel tank and the canister in accordance with operation of an engine control unit, a vapor recirculation valve unit that is connected with the canister, receives fuel vapor from the canister, discharges the fuel vapor to atmosphere or the purge line, and supplies air to the canister, and/or an actuating member that is disposed between the purge line and the vapor recirculation valve unit and actuating the vapor recirculation valve unit when negative pressure is generated in the purge line.

The actuating member may be a one-way check valve supplying the negative pressure to the vapor recirculation valve unit when the negative pressure is generated in the purge line. The pressure control solenoid valve selectively connects an intake manifold and the canister in accordance with operation of the engine control unit. The canister may include a first nipple that is connected with the vapor line, a second nipple that is connected with the purge line, and/or a third nipple that is connected with the vapor recirculation valve unit. A partition may be disposed between the first and second nipples and the third nipple in the canister and a space including the first and second nipples in the canister fluidly communicates with a space including the third nipple in the canister.

The vapor recirculation valve unit may include a first port connected with the third nipple through a first vent line, a second port connected with the purge line through a recirculation line, a third port communicated with the atmosphere through a second vent line configured with a canister close solenoid valve that selectively connects the vapor recirculation valve unit with the atmosphere in accordance with operation of the engine control unit, a fourth port connected with a purge pressure supplying line that is connected with the recirculation line, wherein the actuating member may be provided at the purge pressure supplying line, a valve housing where the first, second, third, and fourth ports are provided, and/or a switching member selectively opening the third port by the negative pressure supplied through the fourth port from the actuating member or by pressure supplied from the canister.

The switching member may include a vent housing that is disposed within the valve housing and connected with the third port, a negative pressure housing that is disposed within the valve housing and connected with the fourth port, and/or a vent housing opening unit, that is disposed within the negative pressure housing and selectively opens the vent housing based on the pressure inside the valve housing or a purge pressure that can be changed according to opening/closing of the pressure control solenoid valve which causes the negative pressure. The pressure control solenoid valve may be displaced between an intake manifold and a connection portion formed between the purge line and the recirculation.

The vent housing opening unit may include a valve plate slidably disposed within the negative pressure housing for forming a negative pressure chamber within the negative pressure housing, and/or an elastic member disposed within the negative pressure chamber and supplying elastic force to the valve plate. The elastic member may be a spring. The vent housing opening unit may be opened approximately at 1.5 kPA-2.0 kPA. A valve packing may be displaced under the valve packing and slidably seals a gap between the valve plate and an interior circumference of the negative pressure housing and a gap between end portion of the vent housing and the valve plate.

Another aspect of the present invention is directed to a fuel vapor recirculation system including a canister that may be connected with a fuel tank through a vapor line and with a purge line configured with a pressure control solenoid valve thereon, a vapor control valve that may be disposed on the vapor line and selectively connects the fuel tank and the canister in accordance with operation of an engine control unit, a vapor recirculation valve unit that may be connected with the canister, receives fuel vapor from the canister, discharges the fuel vapor to atmosphere or the purge line, or supplies air to the canister, and/or an actuating member that may be disposed between the purge line and the vapor recirculation valve unit and actuating the vapor recirculation valve unit when negative pressure is generated in the purge line.

The canister may include a first nipple that is connected with the vapor line, a second nipple that is connected with the purge line, and/or a third nipple that is connected with the vapor recirculation valve unit. The vapor recirculation valve unit may include a first port connected with the third nipple through a first vent line, a second port connected with the purge line through a recirculation line, a third port communicated with the atmosphere through a second vent line configured with a canister close solenoid valve that selectively connects the vapor recirculation valve unit with the atmosphere in accordance with operation of the engine control unit, a fourth port connected with a purge pressure supplying line that is connected with the recirculation line, wherein the actuating member may be provided at the purge pressure supplying line, a valve housing where the first, second, third, and fourth ports are provided, and/or a switching member selectively opening the third port by the negative pressure supplied through the fourth port from the actuating member or by pressure supplied from the canister.

A passenger vehicle may include any of the fuel vapor recirculation device described above. The canister may include a first nipple that is connected with the vapor line, a second nipple that is connected with the purge line, and/or a third nipple that is connected with the vapor recirculation valve unit. The vapor recirculation valve unit may include a first port connected with the third nipple through a first vent line, a second port connected with the purge line through a recirculation line, a third port communicated with the atmosphere through a second vent line configured with a canister close solenoid valve that selectively connects the vapor recirculation valve unit with the atmosphere in accordance with operation of the engine control unit, a fourth port connected with a purge pressure supplying line that is connected with the recirculation line, wherein the actuating member may be provided at the purge pressure supplying line, a valve housing where the first, second, third, and fourth ports are provided, and/or a switching member selectively opening the third port by the negative pressure supplied through the fourth port from the actuating member or by pressure supplied from the canister.

A passenger vehicle may include any of the fuel vapor recirculation systems described above. The canister may include a first nipple that is connected with the vapor line, a second nipple that is connected with the purge line, and/or a third nipple that is connected with the vapor recirculation valve unit. The vapor recirculation valve unit may include a first port connected with the third nipple through a first vent line, a second port connected with the purge line through a recirculation line, a third port communicated with the atmosphere through a second vent line configured with a canister close solenoid valve that selectively connects the vapor recirculation valve unit with the atmosphere in accordance with operation of the engine control unit, a fourth port connected with a purge pressure supplying line that is connected with the recirculation line, wherein the actuating member may be provided at the purge pressure supplying line, a valve housing where the first, second, third, and fourth ports are provided, and/or a switching member selectively opening the third port by the negative pressure supplied through the fourth port from the actuating member or by pressure supplied from the canister.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
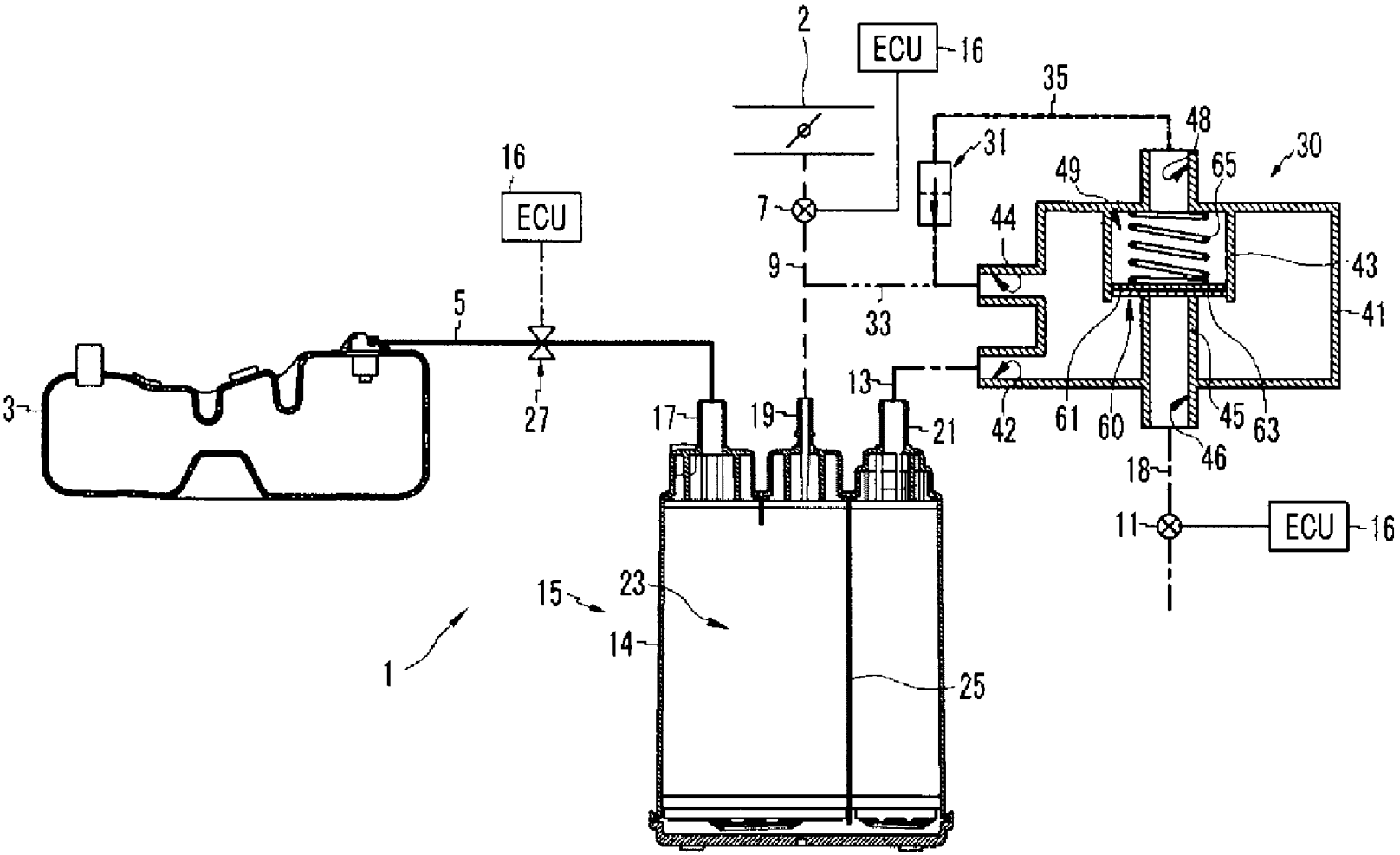
FIG. 1 is a schematic diagram of an exemplary fuel vapor recirculation device in accordance with the present invention.

FIG. 1 is a schematic diagram of a fuel vapor recirculation device according to an exemplary embodiment of the present invention.

A fuel vapor recirculation device 1 according to various embodiments of the present invention includes a canister 15 that is connected with a fuel tank 3 through a vapor line 5, a purge line 9 connected with an intake manifold 2, and a first vent line 13.

A pressure control solenoid valve 7 is disposed on the purge line 9.

The canister 15 includes a canister housing 14, and the canister housing 14 is provided with first, second, and third nipples 17, 19, and 21.

The first nipple 17 is connected with the vapor line 5, the second nipple 19 is connected with the purge line 9, and the third nipple 21 is connected with the first vent line 13.

The canister housing 14 is filled with an absorbent material such as activated carbon 23 for absorbing fuel vapor flowing into the canister 15.

A partition 25 is disposed between the first and second nipples 17 and 19 and the third nipple 21 within the canister housing 14, and the partition 25 is preferably disposed for the fuel vapor to communicate therebetween.

The fuel vapor recirculation device 1, as shown in FIG. 1, includes a vapor control valve 27, a vapor recirculation valve unit 30, and a one-way check valve 31.

The vapor control valve 27 is disposed on the vapor line 5 connecting the first nipple 17 and fuel tank 3, and closes or opens the vapor line 5 according to an operation signal of an ECU 16.

The vapor recirculation valve unit 30 is connected with the canister 15 through the first vent line 13, and a recirculation line 33 connected with the purge line 9.

Also, the vapor recirculation valve unit 30 is connected with the canister 15 through a purge pressure supplying line 35 connected with the recirculation line 33.

The one-way check valve 31 opening only in the direction to the canister 15 is disposed on the purge pressure supplying line 35.

The vapor recirculation valve unit 30 includes a valve housing 41, a negative pressure housing 43, a vent housing 45, and a vent housing opening unit 60.

First, second, third, and fourth ports 42, 44, 46, and 48 are formed to the valve housing 41.

The first port 42 is connected with the first vent line 13, and the second port 44 is connected with the second nipple 19 through the purge line 9.

The third port 46 is communicated with the atmosphere through a second vent line 18 in which the canister close solenoid valve 11 is disposed, and the forth port 48 is connected with the purge pressure supplying line 35.

The third port 46 discharges fuel vapor within the valve housing 41 to the atmosphere according to operation of the canister close solenoid valve 11 or allows air to flow into the valve housing 41.

The pressure control solenoid valve 7, the canister close solenoid valve 11, and the vapor control valve 27 are respectively operated according to control of the ECU 16, and the opening or closing of each valve according to each mode will be explained later.

The negative pressure housing 43 is connected with the fourth port 48 within the valve housing 41.

The vent housing 45 is connected with the third port 46 within the valve housing 41. The vent housing 45 extends toward the negative pressure housing 43 such that a part of the vent housing 45 is disposed therein.

It is preferable that the circumference of the negative pressure housing 43 is larger than that of the vent housing 45.

Also, it is preferable that an end of the vent housing 45 is inserted into the negative pressure housing 43.

The vent housing opening unit 60 is slidably disposed within the negative pressure housing 43, and the vent housing opening unit 60 selectively opens or closes the vent housing 45 in response to internal pressure of the valve housing 41 or a purge pressure generated by opening or closing the pressure control solenoid valve 7.

The vent housing opening unit 60 includes a valve plate 61 that is disposed within the negative pressure housing 43, valve packing 63 disposed under the valve plate 61, and an elastic member 65 disposed within the valve housing 43. In various embodiments of the present invention, the elastic member may be a spring.

The valve plate 61 and the negative pressure housing 43 form a negative pressure chamber 49 and the elastic member is disposed in the negative pressure chamber 49.

The valve packing 63 seals a gap between the valve plate 61 and an interior circumference of the negative pressure housing 43, and also seals a gap between the end of the vent housing 45 and the valve plate 61.

The elastic member 65 is disposed on the valve plate 61 in the negative pressure chamber 49, and supplies elastic force to the valve plate 61 downwards in the drawing.

It is preferable that the vent housing opening unit 60 is operated at 1.5 kPA-2.0 kPA and operated in the case that pressure in the negative pressure chamber 49 is less than the elastic force of the elastic member 65 as the pressure control solenoid valve 7 is opened or that excessive pressure is generated in the canister 15.

Hereinafter, operations of the fuel vapor recirculation device in each mode will be explained.

Figure 2:
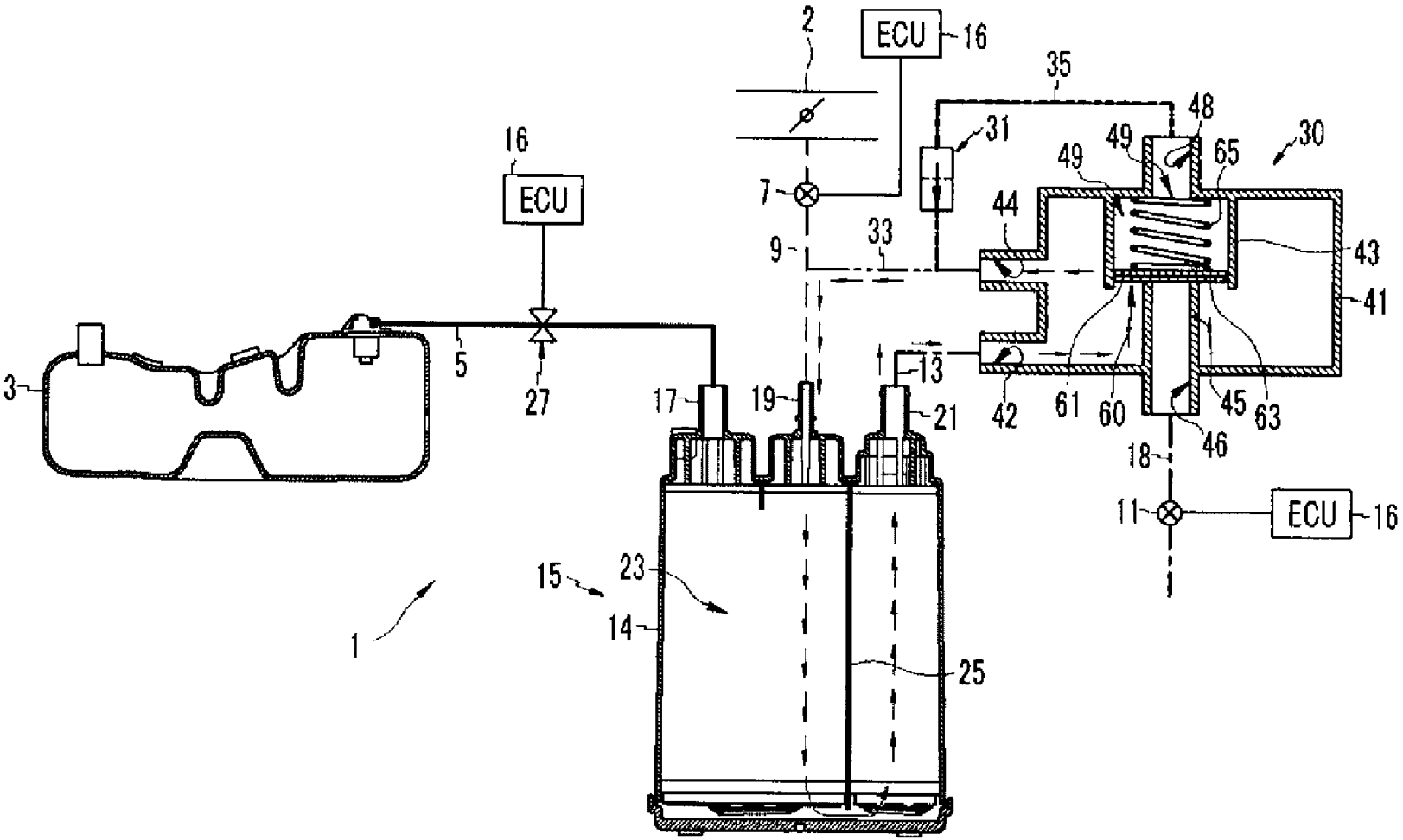
FIG. 2 is a schematic diagram of an exemplary fuel vapor recirculation device in accordance with the present invention showing operation in emission regulation test mode.

FIG. 2 is a schematic diagram of a fuel vapor recirculation device according to an exemplary embodiment of the present invention showing operation in emission regulation test mode.

Referring to FIG. 2, in emission regulation test mode the vapor control valve 27 is closed according to control of the ECU 16 for preventing fuel vapor from being absorbed in the canister 15.

At the same time, the pressure control solenoid valve 7 is opened and the canister control solenoid valve 11 is closed according to control of the ECU 16.

Fuel vapor in the canister 15 may be supplied to the vapor recirculation valve unit 30 through the first vent line 13 and the first port 42 in various embodiments since the pressure in the canister 15 is higher than the pressure in the purge line 9, but in this case the vent housing 45 is not opened because internal pressure of the vent housing opening unit 60 has not reached a predetermined pressure.

Thus, some portion of fuel vapor flowing into the valve housing 41 may return to the canister 15 via the second port 44, the recirculation line 33, and the second nipple 19, and this recirculation is repeated.

However, the flow direction may be determined by flow resistance based on the diameter and length of the recirculation line 33 and the first vent line 13.

That is, fuel vapor within the canister 15 repeatedly returns via the vapor recirculation valve unit 30 and is repeatedly purified by the activated carbon 23.

Also, the fuel vapor recirculation device 1 according to various embodiments of the present invention can minimize fuel vapor discharge to the atmosphere without an assistance canister.

Further, inflow of the fuel vapor from the fuel tank 3 to the canister 15 can be prevented by closing the vapor control valve 27 so that the size of the canister 15 can be reduced and manufacturing cost and weight of the fuel vapor recirculation device can be reduced.

Figure 3:
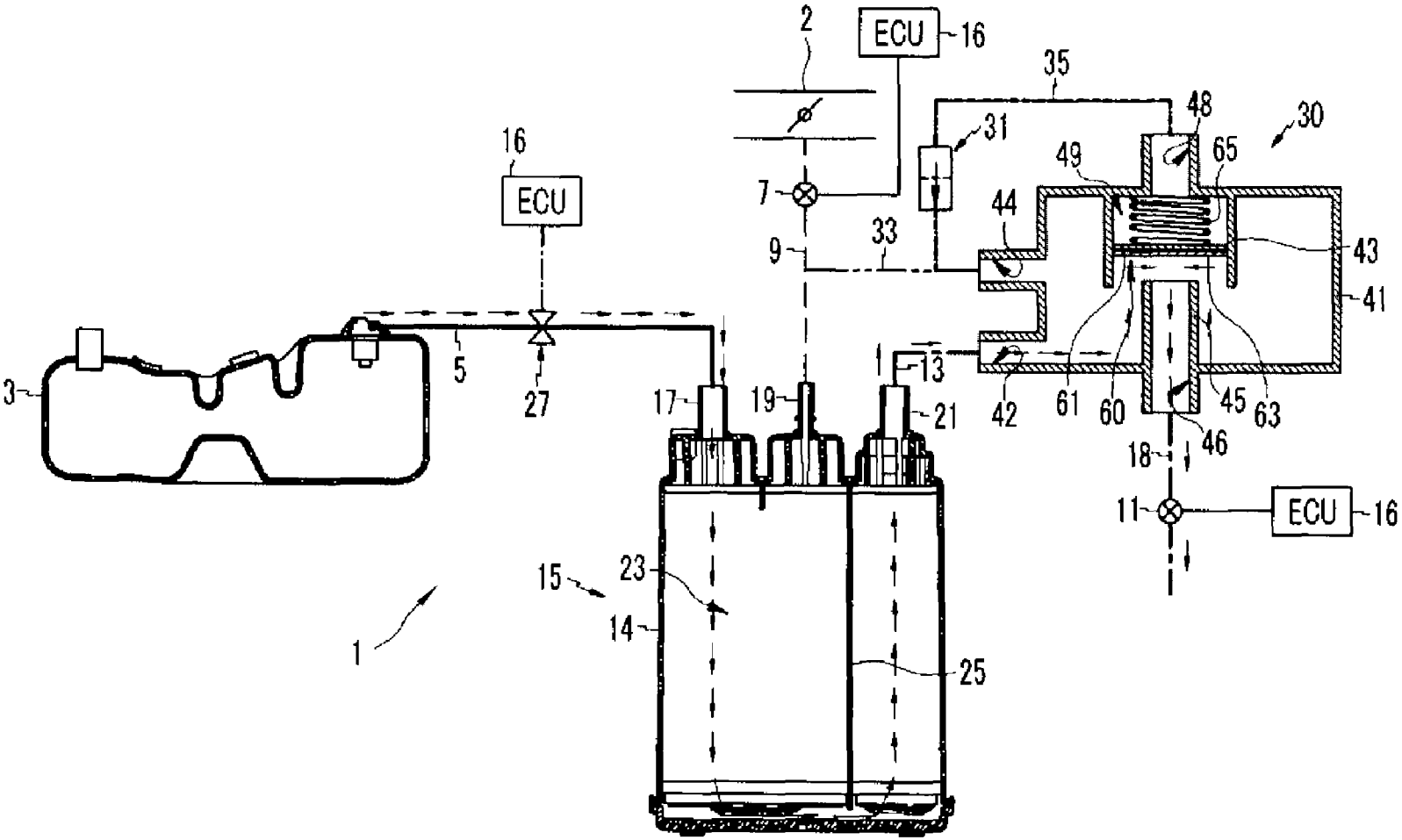
FIG. 3 is a schematic diagram of an exemplary fuel vapor recirculation device in accordance with the present invention showing operation in general fuel feeding mode.

FIG. 3 is a schematic diagram of a fuel vapor recirculation device according to an exemplary embodiment of the present invention showing operation in general fuel feeding mode.

Referring to FIG. 3, in the general fuel feeding mode, the vapor control valve 27 and the canister close solenoid valve 11 are opened and the pressure control solenoid valve 7 is closed according to control of the ECU 16.

When feeding fuel, fuel vapor in the fuel tank 3 is supplied to the canister 15 according to internal pressure of the fuel tank via the vapor line 5, and is supplied to the vapor recirculation valve unit 30 via the third nipple 21 and first vent line 13 and/or the second nipple 19 and recirculation line 33.

The fuel vapor in the valve housing 41 can reach the predetermined pressure of the vent housing opening unit 60 so that the valve plate 61 can be pushed upwards and thus the vent housing 45 can be opened.

Accordingly, the fuel vapor within the valve housing 43 can be discharged to the atmosphere through the third port 46 and the canister close solenoid valve 11.

In the general fuel feeding mode, the fuel vapor is supplied to the vapor recirculation valve unit 30 at high pressure so that the vent housing opening unit 60 can be operated.

The fuel vapor is discharged through the vent housing 45 and the third port 46 so that ventilation resistance can be minimized.

Figure 4:
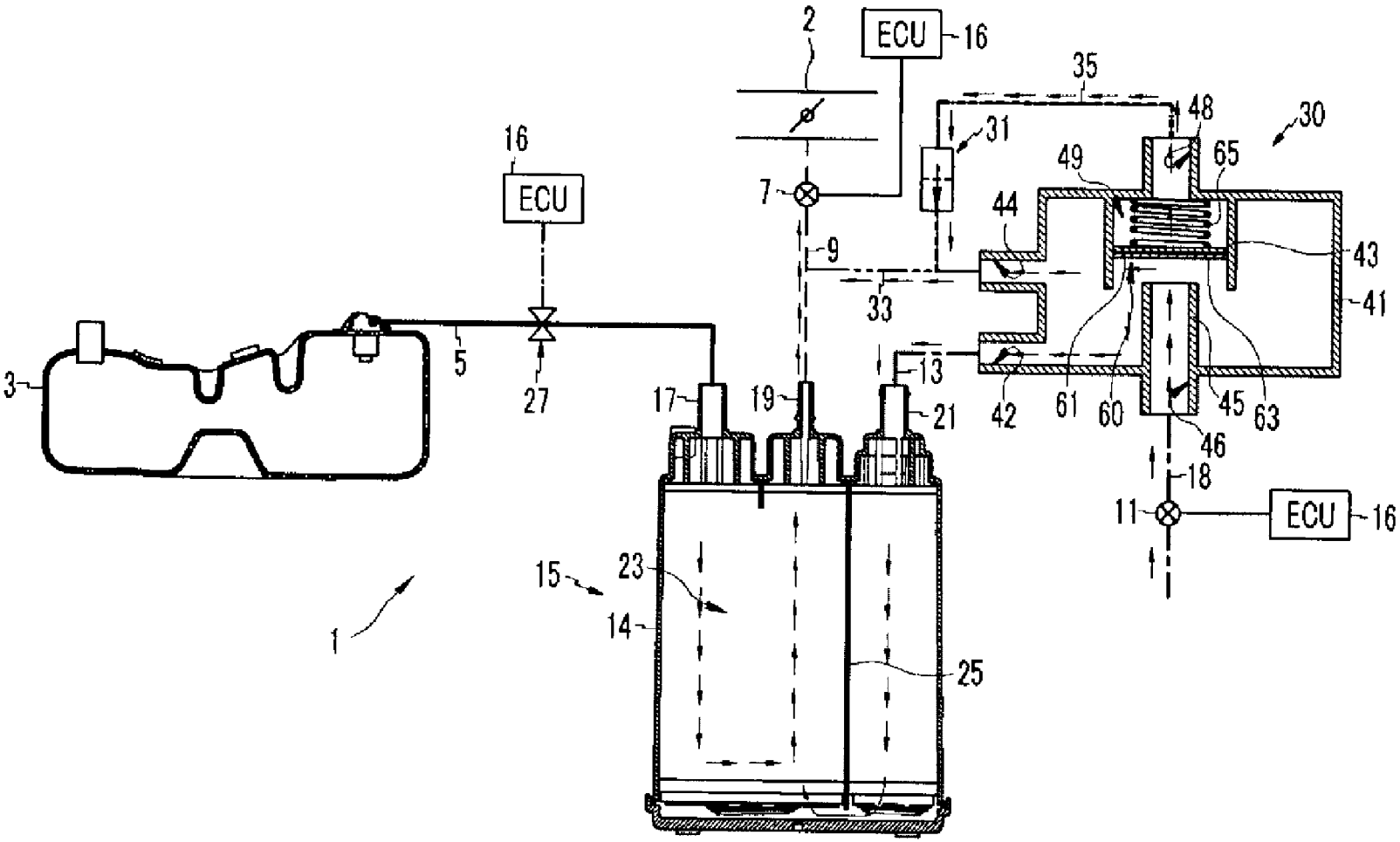
FIG. 4 is a schematic diagram of an exemplary fuel vapor recirculation device in accordance with the present invention showing operation in purge mode.

FIG. 4 is a schematic diagram of a fuel vapor recirculation device according to an exemplary embodiment of the present invention showing operation in purge mode.

In purge mode, referring to FIG. 4, the vapor control valve 27 is closed and the pressure control solenoid valve 7 and canister close solenoid valve 11 are opened according to control of the ECU 16.

The fuel vapor in the canister 15 is supplied to an intake manifold 2 through the purge line 9, and thus purge negative pressure within the purge line 9 is generated, is transmitted to the purge pressure supplying line 35, and opens the one-way check valve 31.

The one-way check valve 31 operates the vent housing opening unit 60 and opens the vent housing unit 45. Thus, air is supplied to the vapor recirculation valve unit 30 through the canister close solenoid valve 11 and the second vent line 18.

The air supplied to the vapor recirculation valve unit 30 is simultaneously supplied to the canister 15 through the first port 42 and the intake manifold 2 through the second port 44, the recirculation line 33, and the purge line 9.

In purge mode, the purge negative pressure generated in the purge line 9 by opening of the pressure control solenoid valve 7 is not supplied to the fuel tank due to closing of the vapor control valve 27 so that the fuel tank 3 can be prevented from contraction.

Also, the air is supplied to the canister 15 so that the fuel vapor in the canister 15 is efficiently supplied to the intake manifold 2.

Figure 5:
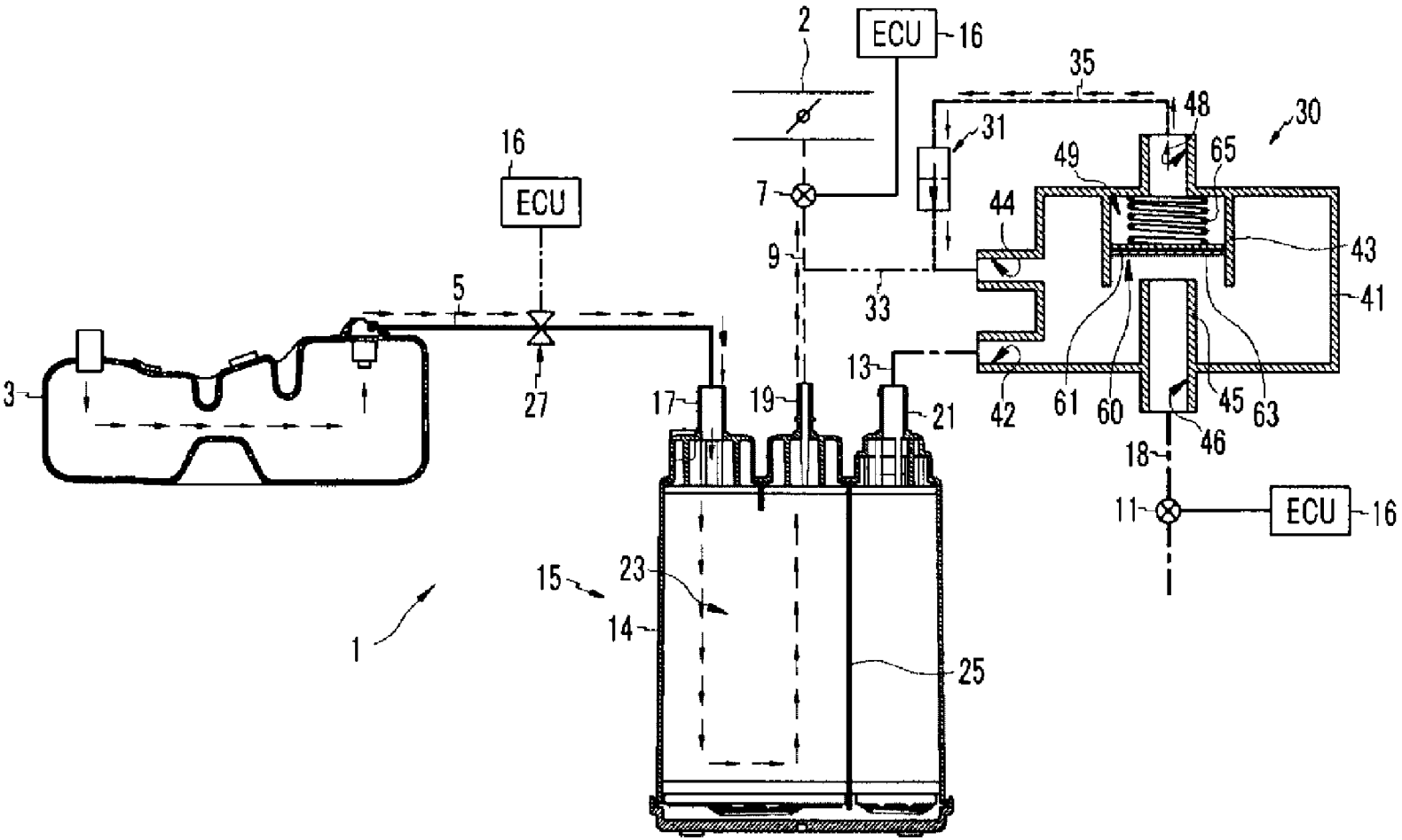
FIG. 5 is a schematic diagram of an exemplary fuel vapor recirculation device in accordance with the present invention showing operation in leak monitoring mode.
Figure 6:
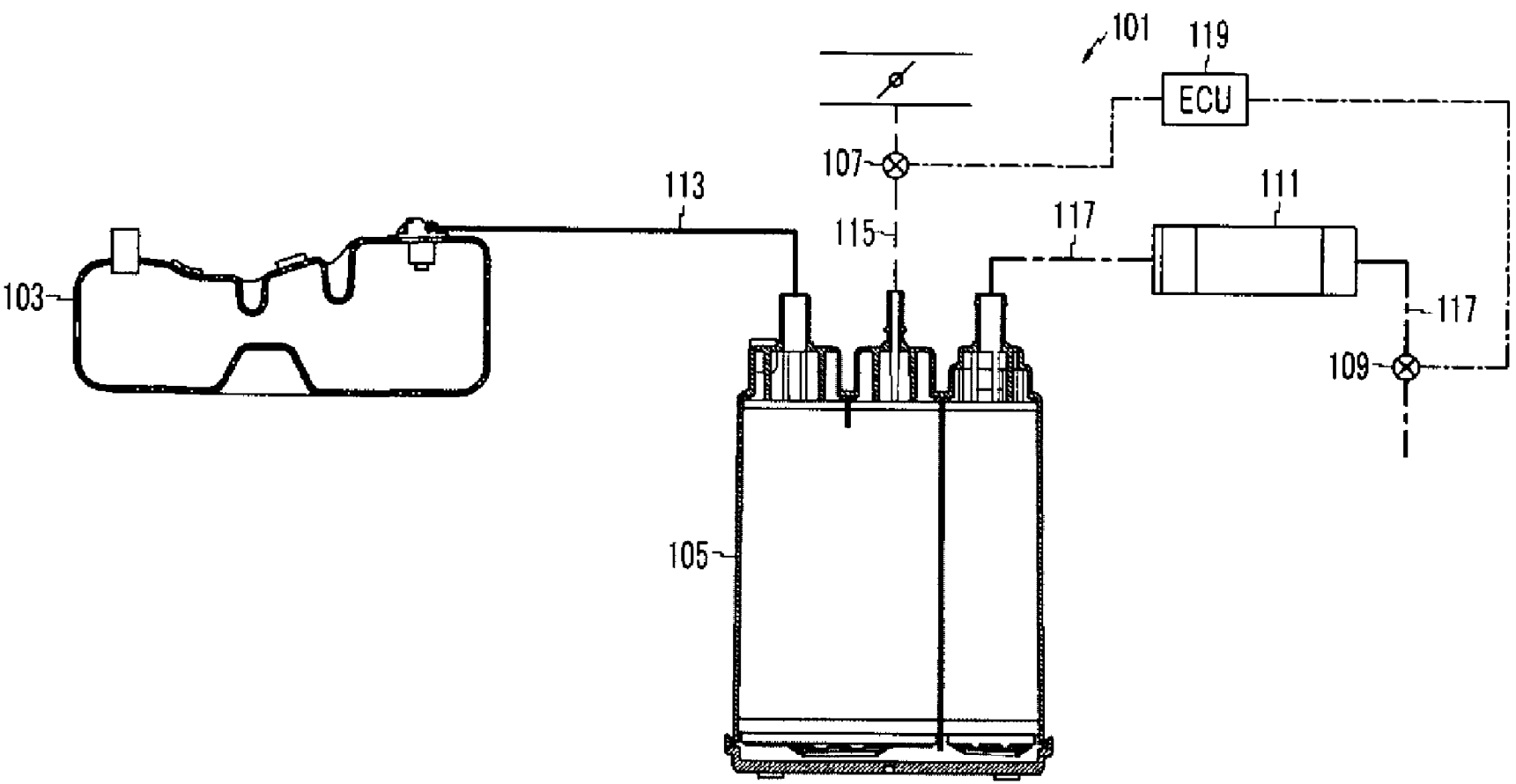
FIG.6 (PRIOR ART)
FIG. 6 is a schematic diagram of a conventional fuel vapor recirculation device.

FIG. 5 is a schematic diagram of a fuel vapor recirculation device according to an exemplary embodiment of the present invention showing operation in leak monitoring mode.

In the leak monitoring mode, referring to FIG. 5, the vapor control valve 27 and the pressure control solenoid valve 7 are opened and the canister close solenoid valve 11 is closed.

Fuel vapor in the fuel tank 3 flows into the canister 15 though the vapor line 5, and then flows to the intake manifold 2 for combustion in an engine through the second nipple 19 and the purge line 9.

Purge negative pressure generated in the purge line 9 opens the one-way check valve 31, and the one-way check valve 31 operates the vent housing opening unit 60 so that the vent housing 45 is opened.

The canister close solenoid valve 11 is closed so that air is not supplied to the vapor recirculation valve unit 30, and thus leak monitoring is not influenced.

That is, in the leak monitoring mode, the purge negative pressure generated by opening of the pressure control solenoid valve 7 is quickly transmitted to the fuel tank via the vapor line 5 and causes a fluctuation of interior pressure of the fuel tank 3.

As described above, the fuel vapor recirculation device 1 according to various embodiments of the present invention includes the vapor control valve 27, the vapor recirculation valve unit 30, and the one-way check valve 31 that replace a conventional assistance canister for recirculation of the fuel vapor from the canister 15 to the canister again, and the fuel vapor recirculation device 1 can reduce the fuel vapor to be discharged to the atmosphere.

Further, the purge pressure is prevented from being transmitted to the fuel tank 3 by closing the vapor control valve 27 so that repeated contraction and expansion of the fuel tank 3 by engine negative pressure can be prevented. Also, the fuel vapor recirculation device 1 according to various embodiments of the present invention uses the vapor recirculation valve unit 30 replacing a conventional assistance canister so that manufacturing cost and weight of the fuel vapor recirculation 1 can be reduced and layout can be simplified.

That is, purge pressure is not directly transmitted to a fuel tank though a vapor control valve so that repeated contraction of the fuel tank due to engine negative pressure can be prevented, manufacturing cost and weight can be reduced for replacing an assistance canister to a vapor recirculation valve unit, and layout can be simplified.

For convenience in explanation and accurate definition in the appended claims, the terms "upwards", "inside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A fuel vapor recirculation device comprising:

a canister that is connected with a fuel tank through a vapor line and with a purge line configured with a pressure control solenoid valve;

a vapor control valve that is disposed on the vapor line and selectively connects the fuel tank and the canister in accordance with operation of an engine control unit;

a vapor recirculation valve unit that is connected with the canister, receives fuel vapor from the canister, discharges the fuel vapor to atmosphere or the purge line, and supplies air to the canister; and an actuating member that is disposed between the purge line and the vapor recirculation valve unit and actuating the vapor recirculation valve unit when negative pressure is generated in the purge line;

wherein the vapor recirculation valve unit comprises:

a first port connected with the third nipple through a first vent line;

a second port connected with the purge line through a recirculation line;

a third port communicated with the atmosphere through a second vent line configured with a canister close solenoid valve that selectively connects the vapor recirculation valve unit with the atmosphere in accordance with operation of the engine control unit;

a fourth port connected with a purge pressure supplying line that is connected with the recirculation line, wherein the actuating member is provided at the purge pressure supplying line;

a valve housing where the first, second, third, and fourth ports are provided; and a switching member selectively opening the third port by the negative pressure supplied through the fourth port from the actuating member or by pressure supplied from the canister.

2. The fuel vapor recirculation device of claim 1, wherein the actuating member is a one-way check valve supplying the negative pressure to the vapor recirculation valve unit when the negative pressure is generated in the purge line.

3. The fuel vapor recirculation device of claim 1, wherein the pressure control solenoid valve selectively connects an intake manifold and the canister in accordance with operation of the engine control unit.

4. The fuel vapor recirculation device of claim 1, wherein the canister comprises:

a first nipple that is connected with the vapor line;

a second nipple that is connected with the purge line; and a third nipple that is connected with the vapor recirculation valve unit.

5. The fuel vapor recirculation device of claim 4, wherein a partition is disposed between the first and second nipples and the third nipple in the canister and a space including the first and second nipples in the canister fluidly communicates with a space including the third nipple in the canister.

6. The fuel vapor recirculation device of claim 1, wherein the switching member comprises:

a vent housing that is disposed within the valve housing and connected with the third port;

a negative pressure housing that is disposed within the valve housing and connected with the fourth port; and a vent housing opening unit, that is disposed within the negative pressure housing and selectively opens the vent housing based on the pressure inside the valve housing or a purge pressure that can be changed according to opening/closing of the pressure control solenoid valve which causes the negative pressure.

7. The fuel vapor recirculation device of claim 1, wherein the pressure control solenoid valve is displaced between an intake manifold and a connection portion formed between the purge line and the recirculation.

8. The fuel vapor recirculation device of claim 6, wherein the vent housing opening unit comprises:

a valve plate slidably disposed within the negative pressure housing for forming a negative pressure chamber within the negative pressure housing; and an elastic member disposed within the negative pressure chamber and supplying elastic force to the valve plate.

9. The fuel vapor recirculation device of claim 8, wherein the elastic member is a spring.

10. The fuel vapor recirculation device of claim 8, wherein the vent housing opening unit is opened approximately at 1.5 kPA-2.0 kPA.

11. The fuel vapor recirculation device of claim 8, wherein a valve packing is displaced under the valve packing and slidably seals a gap between the valve plate and an interior circumference of the negative pressure housing and a gap between end portion of the vent housing and the valve plate.

12. A passenger vehicle comprising the fuel vapor recirculation device as defined in claim 1, wherein the canister comprises:

a first nipple that is connected with the vapor line;

a second nipple that is connected with the purge line; and a third nipple that is connected with the vapor recirculation valve unit.

13. A fuel vapor recirculation system comprising:

a canister that is connected with a fuel tank through a vapor line and with a purge line configured with a pressure control solenoid valve thereon;

a vapor control valve that is disposed on the vapor line and selectively connects the fuel tank and the canister in accordance with operation of an engine control unit;

a vapor recirculation valve unit that is connected with the canister, receives fuel vapor from the canister, discharges the fuel vapor to atmosphere or the purge line, or supplies air to the canister; and an actuating member that is disposed between the purge line and the vapor recirculation valve unit and actuating the vapor recirculation valve unit when negative pressure is generated in the purge line;

wherein the vapor recirculation valve unit comprises:

a first port connected with the third nipple through a first vent line;

a second port connected with the purge line through a recirculation line;

a third port communicated with the atmosphere through a second vent line configured with a canister close solenoid valve that selectively connects the vapor recirculation valve unit with the atmosphere in accordance with operation of the engine control unit;

a fourth port connected with a purge pressure supplying line that is connected with the recirculation line, wherein the actuating member is provided at the purge pressure supplying line;

a valve housing where the first, second, third, and fourth ports are provided; and a switching member selectively opening the third port by the negative pressure supplied through the fourth port from the actuating member or by pressure supplied from the canister.

14. The fuel vapor recirculation system of claim 13, wherein the canister comprises:

a first nipple that is connected with the vapor line;

a second nipple that is connected with the purge line; and a third nipple that is connected with the vapor recirculation valve unit.

15. A passenger vehicle comprising a fuel vapor recirculation system having:

a canister that is connected with a fuel tank through a vapor line and with a purge line configured with a pressure control solenoid valve thereon;

a vapor control valve that is disposed on the vapor line and selectively connects the fuel tank and the canister in accordance with operation of an engine control unit;

a vapor recirculation valve unit that is connected with the canister, receives fuel vapor from the canister, discharges the fuel vapor to atmosphere or the purge line, or supplies air to the canister; and an actuating member that is disposed between the purge line and the vapor recirculation valve unit and actuating the vapor recirculation valve unit when negative pressure is generated in the purge line;

wherein the canister comprises:

a first nipple that is connected with the vapor line;

a second nipple that is connected with the purge line; and a third nipple that is connected with the vapor recirculation valve unit; and wherein the vapor recirculation valve unit comprises:

a first port connected with the third nipple through a first vent line;

a second port connected with the purge line through a recirculation line;

a third port communicated with the atmosphere through a second vent line configured with a canister close solenoid valve that selectively connects the vapor recirculation valve unit with the atmosphere in accordance with operation of the engine control unit;

a fourth port connected with a purge pressure supplying line that is connected with the recirculation line, wherein the actuating member is provided at the purge pressure supplying line;

a valve housing where the first, second, third, and fourth ports are provided; and a switching member selectively opening the third port by the negative pressure supplied through the fourth port from the actuating member or by pressure supplied from the canister.

* * * * *